United States Patent [19]

Kaempfe et al.

[11] Patent Number: 4,703,692

[45] Date of Patent: Nov. 3, 1987

[54] CLAMPING DEVICE FOR COUNTER PRESSURE MEMBER OF A CLEANING DEVICE

[75] Inventors: Joerg Kaempfe; Wolfgang Meurer; Otto Nedwig, all of Dresden, German Democratic Rep.

[73] Assignee: Veb Kombinat Polygraph "Werner Lamberz" Leipzig, Leipzig, German Democratic Rep.

[21] Appl. No.: 797,142

[22] Filed: Nov. 4, 1985

[30] Foreign Application Priority Data

Nov. 8, 1984 [DD] German Democratic Rep. ..... 2692485

[51] Int. Cl.[4] ..... B41F 35/00; B41L 41/00

[52] U.S. Cl. ..... 101/425; 101/167; 15/256.51; 118/203

[58] Field of Search ..... 101/155, 156, 160, 161, 101/162, 165, 166, 167, 168, 423, 425; 15/256.5, 256.51; 118/104, 203; 198/494; 355/15

[56] References Cited

U.S. PATENT DOCUMENTS

| | | | |
|---|---|---|---|
| 189,377 | 4/1877 | Neale | 101/167 |
| 321,743 | 7/1885 | Milligan | 101/168 |
| 693,510 | 2/1902 | Fullard | 101/168 |
| 1,147,152 | 7/1915 | Eaton | 101/156 |
| 4,344,361 | 8/1982 | MacPhee et al. | 101/141 |
| 4,367,691 | 1/1983 | Bergs | 15/256.51 |
| 4,458,376 | 7/1984 | Sitko | 15/256.5 |
| 4,537,130 | 8/1985 | Theilacker | 101/425 |

FOREIGN PATENT DOCUMENTS

| | | | |
|---|---|---|---|
| 474362 | 8/1969 | Switzerland . | |
| 2065561 | 7/1981 | United Kingdom | 101/168 |

*Primary Examiner*—Edgar S. Burr
*Assistant Examiner*—David A. Wiecking
*Attorney, Agent, or Firm*—Michael J. Striker

[57] ABSTRACT

A clamping device for a pressure medium-loaded counter pressure member for applying pressure against a body to be cleaned, such as a cylinder in a washing device of a printing machine, includes a clamping bar connected to one end of a plate-like elastic member which is turned to enclose the counter pressure member, and a covering bar. The covering bar and the clamping bar are connected by bolts to sealingly clamp the counter pressure member with the elastic member.

3 Claims, 4 Drawing Figures

FIG. 2
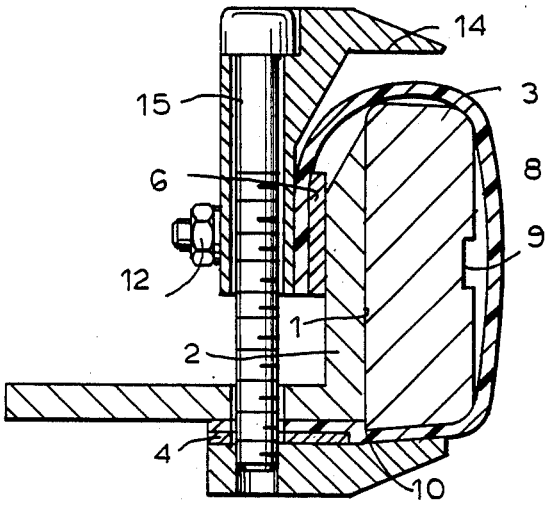
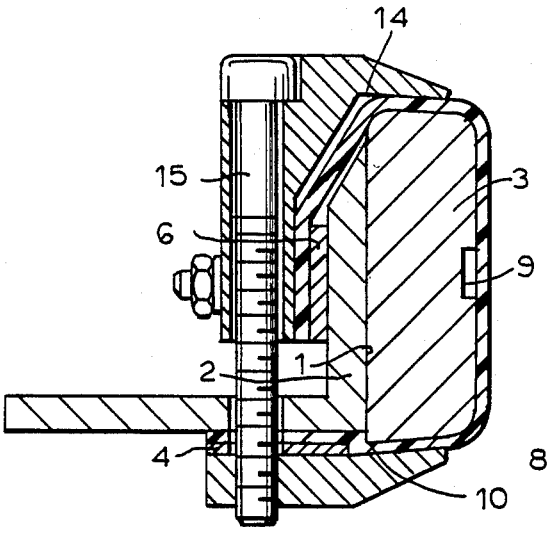
FIG. 3

CLAMPING DEVICE FOR COUNTER PRESSURE MEMBER OF A CLEANING DEVICE

BACKGROUND OF THE INVENTION

The present invention relates to a clamping device on a pressure medium-loaded counter pressure member for applying pressure, for example against a washing cloth applied to a printing cylinder or a roller for cleaning the same in a printing machine. The washing cloth is supplied from a supply roll and is brought into contact with the surface of the roller or cylinder to be cleaned by means of an expandable counter pressure member.

Pressure medium-loaded counter pressure members have been known in printing industry for applying a uniform wiper pressure over the entire useful width of the printing machine.

A counter pressure member disclosed in CH 474 362 includes a base member which encloses an elastic hollow element at three sides thereof so that this element lies with its free side on the underside of the pressure cover. Upon loading of the elastic hollow element with the pressure medium a uniformly acting pressure is exerted on the pressure cover over the entire work width.

The disadvantage of such conventional counter pressure member resides in that the elastic hollow element can be prepared only by special methods and the size of the counter pressure element is defined by the size of the hollow element.

A counter pressure member disclosed in DT-OS 3,005,469 is comprised of a U-shaped profile over which a rubber element is pulled; the arms of this profile are screwed to the walls and to the rubber element. This rubber element is provided with beads at the sides thereof. Respectively deformed elements are engaged with those beads so that the rubber element is locked on the U-shaped profile.

Also known is a counter pressure member in which in place of the U-shaped profile a rectangular profile is utilized, on which the aforementioned rubber element is arranged. This rubber element can via the pressure medium connection be loaded with pressure medium so as to apply pressure to the washing cloth and bring the latter into contact with the roller or the cylinder to be cleaned.

The disadvantage of the above described counter pressure member is that the rubber element which has the thickness over 3 mm is brought to the base member with a uniform stressing and clamped thereon in order to ensure incorresponding operational conditions predetermined end positions or a uniform wiper pressure. For the application of the rubber element to the base member and for ensuring a uniform pre-stressing it has been required that a user for maintaining a damage-free production would obtain a complete counter pressure member as a replacement unit.

SUMMARY OF THE INVENTION

It is an object of the present invention to provide an improved clamping device for a counter pressure member of a cleaning arrangement of the printing machine.

It is another object of this invention to provide a clamping device in which an exchange of the elastic element on the counter pressure member would be facilitated due to the use of a plate-shaped elastic member.

It is yet another object of the invention to provide a clamping device in which the elastic element simultaneously clamps the coutner pressure member and provides a pressure medium-sealed joint.

These and other objects of the invention are attained by a clamping device on a counter pressure member loaded with pressure medium and having an elastic element for applying pressure, for example in washing devices of printing machines, comprising a clamping bar; a covering bar; and connection elements, said elastic element being fixable to said counter pressure member and to said clamping bar, and said covering bar and said connection elements so as to clamp and seal said counter pressure member.

The counter pressure member may include two elements offset relative to each other to form an abutment; said connection elements including strips extending parallel to said abutment and at a distance therefrom and bolts extending through said strips for connecting said elastic element to said counter pressure member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 2 is a sectional view taken on line A—A of FIG. 1 in the position of the clamping device during the clamping process;

FIG. 3 is a sectional view taken along line A—A of FIG. 1 of the device in a clamped position.

DETAILED DESCRIPTION OF THE PREFERRED EMBODIMENTS

Figure 1:
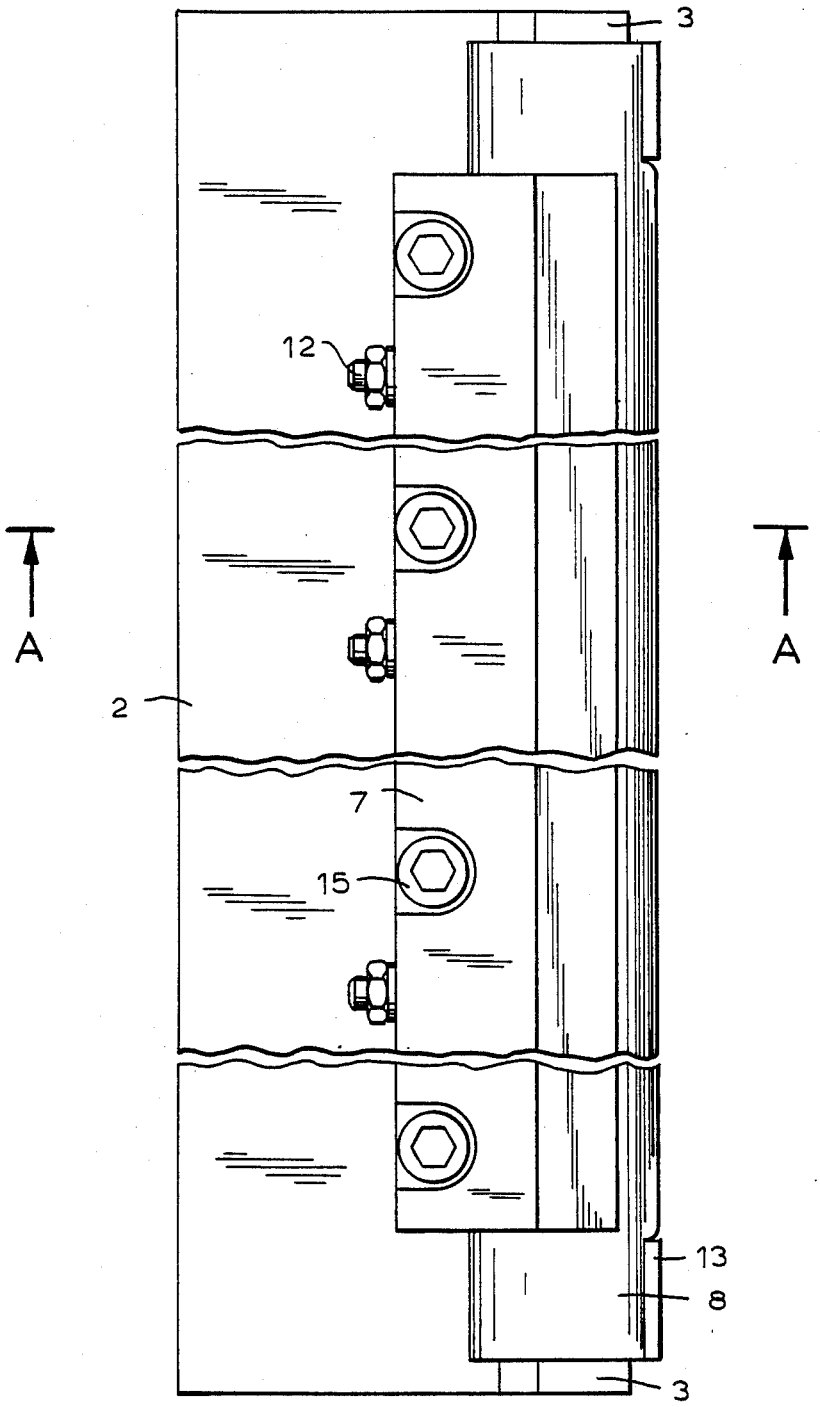
FIG. 1 is a top plan view of the clamping device of the present invention.

Referring now to the drawings in detail, and firstly to FIG. 3 thereof, it will be seen that a counter pressure member for a cleaning device for cleaning a printing cylinder of a printing machine is comprised of a base member 1 which is assembled of an angular profile 2 and a rectangular profile 3 so that a sharp-edged abutment or stop 10 is formed between the two profiles. The side surfaces of the rectangular profile 3 extend obliquely or conically while a groove 9 is formed at the front side of this profile. A pressure medium connection (non-shown) opens into groove 9. An elastic element 8 surrounds the base member 1 and is fixed with its end to the free arm of the angular profile 2 by means of a strip 4 and bolts 11 (FIG. 4).

The elastic element 8 is formed of strip-like or plate-like material and is locked at its other end to a clamping bar 7 by a strip 6 and bolts 12. The clamping bar 7 is in connection with a covering bar 5 by bolts 15 which press the covering bar 5 and clamping bar 7 together so that a pressure medium-sealed joint is produced. Laterally of the clamping device, a pressure-medium sealing joint is obtained by plates 13 shown in FIG. 1.

Upon loading of the elastic element 8 with the pressure medium this element expands and exerts a uniform wiper pressure on a washing cloth placed against a printing cylinder to be cleaned and transported along this printing cylinder by transport rollers, for example in a cleaning device of the printing machine.

Figure 4:
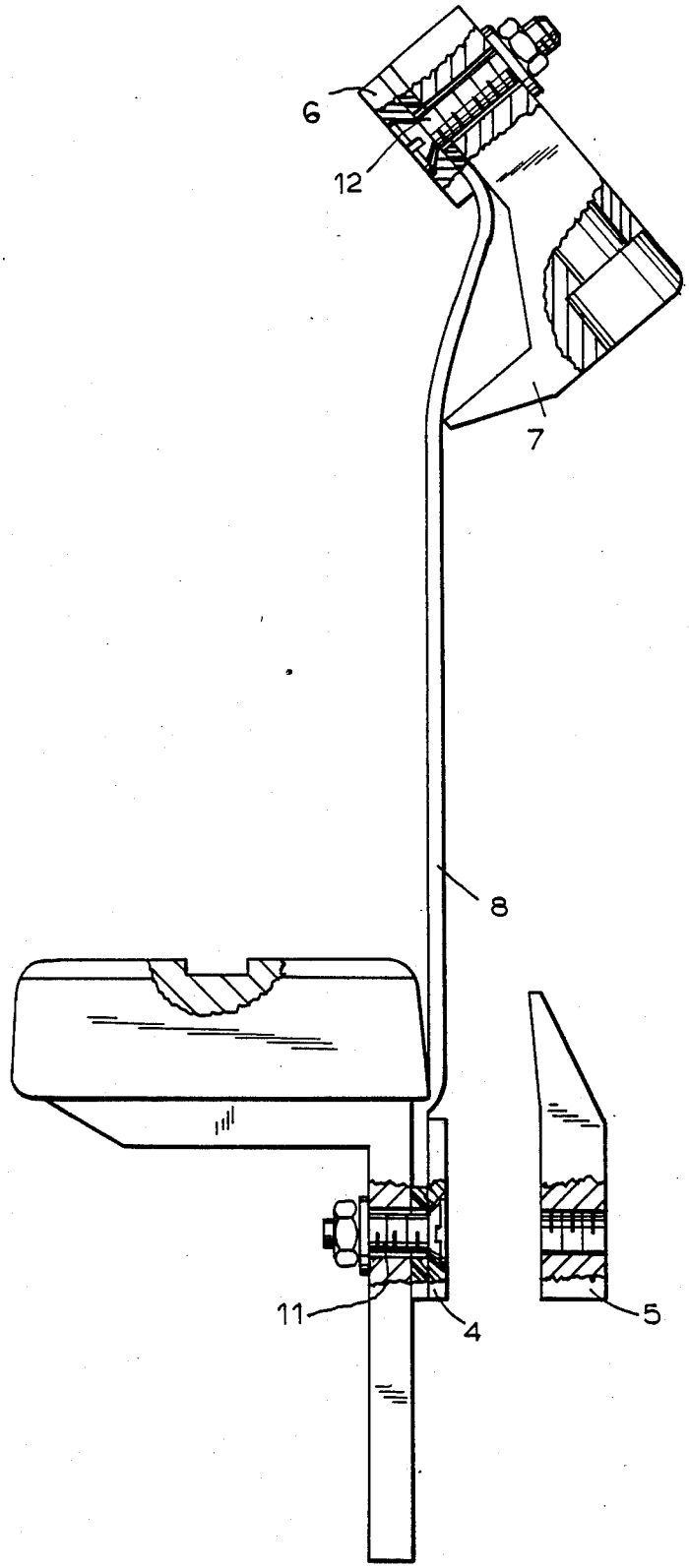
FIG. 4 is a side view of the counter pressure member before the clamping process.

The lining-up of the base member 1 with the elastic element 8 is obtained, as shown in FIG. 4, in which one end of the elastic element 8 is connected by the strip 4 and bolts 11 to the free end or arm of the angular profile 2 and the other end of element 8 is connected by the strip 6 and bolts 12 to the clamping bar 7. Then the clamping bar 7 is placed above the covering bar 5 below the base member 1 so that bolts 15 can be screwed in as illustrated in FIG. 2.

FIG. 2 also shows that the elastic element 8 due to its stiffness does not evenly lie on the outer surface of the rectangular profile 3 but a non-defined curve remains on the element 8. If in this condition a pressure medium-sealed joint is established, for example by fastening the strips to the conical side surfaces of the rectangular profile 3 no uniform wiper pressure can be produced any longer upon the loading with the pressure medium. Therefore the adjustment of a predetermined gap between the counter pressure member and the upper surface of the cylinder or roller to be cleaned is impossible. It is also required that the elastic element 8 should lie uniformly tightly on the upper surface of the rectangular profile 3 in the inoperative position.

Upon further screwing-in of the bolts 15 the elastic element 8 is so clamped that it tightly lies against the outer face of profile 3. Then clamping jaws 14 of the clamping bar 7 and the covering bar 5 are pressed against the conical sides of the rectangular profile 3 and form thereby a pressure medium-sealed joint. Upon the application of plates 13 a respective joint is obtained at the front sides.

The length of the expanded elastic element 8 is selected so that the clamping bar 7 with the elastic element 8 secured thereto can pivot without any auxiliary means immediately over the base member 1 and bolts 15 can be engaged in the covering bar 5.

FIG. 4 clearly shows how the clamping bar 7, secured to the end of the plate-like elastic element 8, can be turned over the two-part counter pressure member to be placed to the position shown in FIG. 2.

It will be undertood that each of the elements described above, or two or more together, may also find a useful application in other types of clamping devices differing from the types described above.

While the invention has been illustrated and described as embodied in a clamping device for a pressure medium-loaded member in a cleaning device of a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamping device on a counter pressure member loaded with a pressure medium and having an elastic element for applying pressure against a washing cloth of a washing device for cleaning a cylinder of a printing machine, said clamping device being placeable from a non-clamping position before a clamping process to a clamping position and comprising:

a clamping bar;

a covering bar spaced from said clamping bar to receive therebetween said counter pressure member and the elastic element thereof in said clamping position;

and connection elements, said elastic element being a strip fixed to said counter pressure member at one end thereof and, at another end thereof, to said clamping bar, said strip extending between said counter pressure member and said clamping member when the clamping device is placed in said non-clamping position, said elastic element being partially wrapped about said counter pressure member to tightly surround the latter when the clamping device is placed in said clamping position with said connection elements connecting said clamping bar to said covering bar with interposition therebetween of said counter pressure member with said strip so as to clamp and seal said counter pressure member in operation.

2. The clamping device as defined in claim 1, said counter pressure member including two elements offset relative to each other to form an abutment; said elastic element abutting said abutment in said clamping position; said connection elements including strips extending parallel to said abutment and bolts extending through said strips for connecting said counter pressure member with said clamping bar and said covering bar.

3. The clamping device as defined in claim 2, wherein said elastic element surrounds said counter pressure member at three sides thereof in said clamping position.

* * * * *